US010413049B2

(12) United States Patent
Dovellos et al.

(10) Patent No.: US 10,413,049 B2
(45) Date of Patent: Sep. 17, 2019

(54) MAKEUP BRUSH FOR COSMETIC APPLICATION WITH A CONCAVE PROFILE

(71) Applicant: Royal Brush Manufacturing, Inc., Munster, IN (US)

(72) Inventors: Michael C. Dovellos, Dyer, IN (US); Susan L. Kelly, Portage, IN (US)

(73) Assignee: Royal Brush Manufacturing, Inc., Munster, IN (US)

( * ) Notice: Subject to any disclaimer, the term of this patent is extended or adjusted under 35 U.S.C. 154(b) by 160 days.

(21) Appl. No.: 15/368,212

(22) Filed: Dec. 2, 2016

(65) Prior Publication Data

US 2018/0153292 A1 Jun. 7, 2018

(51) Int. Cl.

| | |
|---|---|
| ***A46B 9/02*** | (2006.01) |
| ***A45D 40/26*** | (2006.01) |
| ***A46D 1/04*** | (2006.01) |

(52) U.S. Cl.

CPC ..... *A46B 9/021* (2013.01); *A45D 40/262* (2013.01); *A46B 9/025* (2013.01); *A46B 9/028* (2013.01); *A46D 1/04* (2013.01); *A46B 2200/106* (2013.01); *A46B 2200/1053* (2013.01)

(58) Field of Classification Search

CPC ..... A46B 9/021; A46B 9/025; A46B 9/028; A45D 40/262; A46D 1/04

See application file for complete search history.

(56) References Cited

U.S. PATENT DOCUMENTS

| | | | | |
|---|---|---|---|---|
| 5,765,573 | A | 6/1998 | Gueret | |
| 6,026,824 | A | 2/2000 | Gueret | |
| 8,060,971 | B1 | 11/2011 | Castelluccio | |
| 2005/0252824 | A1* | 11/2005 | Christian | A45D 40/262 206/581 |
| 2006/0248669 | A1* | 11/2006 | Dovellos | A46B 3/12 15/159.1 |

FOREIGN PATENT DOCUMENTS

WO WO 2016/164046 A1 10/2016

OTHER PUBLICATIONS

International Search Report and Written Opinion of the International Searching Authority dated Feb. 23, 2018 for PCT Application No. PCT/US2017/063922 (12 pp.).

Internet page, "Royal & Langnickel—Brushes, by Series Name, AQUALON WISP™," http://www.royalbrushstore.com/c/brushes_by-series-name_aqualon-wisp, printed Dec. 2, 2016, 1 pg.

* cited by examiner

*Primary Examiner* — Shay Karls

(74) *Attorney, Agent, or Firm* — Brinks Gilson & Lione

(57) ABSTRACT

In one aspect, the present disclosure provides a makeup brush. The makeup brush may include a brush portion secured to a forward end of a ferrule. The brush portion may include a plurality of tuft groups, where each tuft group is formed by a plurality of bristles. The tuft groups may form a concave profile at a working end of the makeup brush, and the concave profile may be configured to match a profile of human eyelashes.

20 Claims, 1 Drawing Sheet

MAKEUP BRUSH FOR COSMETIC APPLICATION WITH A CONCAVE PROFILE

TECHNICAL FIELD

The present disclosure relates generally to a makeup brush, and more particularly, to a makeup brush with a tuft or bristle profile for the application of mascara or other cosmetic product to human eyelashes.

BACKGROUND

A makeup brush is a tool typically used during the application of makeup or another cosmetic product to human skin, such as on a human face. Typically, a makeup brush for application of highlighter makeup or contour makeup, for example, will include a plastic or wooden handle secured to a brush portion. The brush portion typically includes many long and flexible bristles made of natural or synthetic materials.

Makeup brushes are often used to apply makeup called mascara to human eyelashes, which may provide the eyelashes with an aesthetically-pleasing darker and thicker appearance. Typically, brushes used during mascara application (also called mascara brushes or wands) include an elongated shaft with a cylindrical brush portion defined by bristles extending radially away from the shaft. The brush portion in a typical mascara brush does not match the common eyelash profile of a human, and therefore the brush must be maneuvered around the eyelash profile to ensure complete coverage. Further, it may be difficult to separate lashes with a traditional eyelash brush.

BRIEF DESCRIPTION

In one aspect, the present disclosure provides a makeup brush. The makeup brush may include a brush portion secured to a forward end of a ferrule. The brush portion may include a plurality of tuft groups, where each tuft group is formed by a plurality of bristles. The tuft groups may form a concave profile at a working end of the makeup brush, and the concave profile may be configured to match a profile of human eyelashes.

The plurality of tuft groups may include at least a first pair of tuft groups and a second pair of tuft groups, where a length of the first pair of tuft groups measured from the forward end of the ferrule to a terminus of the first pair of tuft groups is greater than a length of the second pair of tuft groups measured from the forward end of the ferrule to a terminus of the second pair of tuft groups.

The makeup brush may include a third pair of tuft groups, where each tuft group of the third pair of tuft groups is located between a tuft group of the first and second pairs of tuft groups.

The first pair of tuft groups may be an outer pair and the second pair of tuft groups may be an inner pair.

A gap may be located between each of the plurality of tuft groups.

A width of the brush portion measured from outer extremes of the outer-most tuft groups may be between about 1 cm and about 3 cm.

At least one of the tuft groups of the plurality of tuft groups may be tapered.

A handle may be secured to a rearward end of the ferrule.

DESRIPTION OF THE DRAWINGS

DETAILED DESCRIPTION

Figure 1:
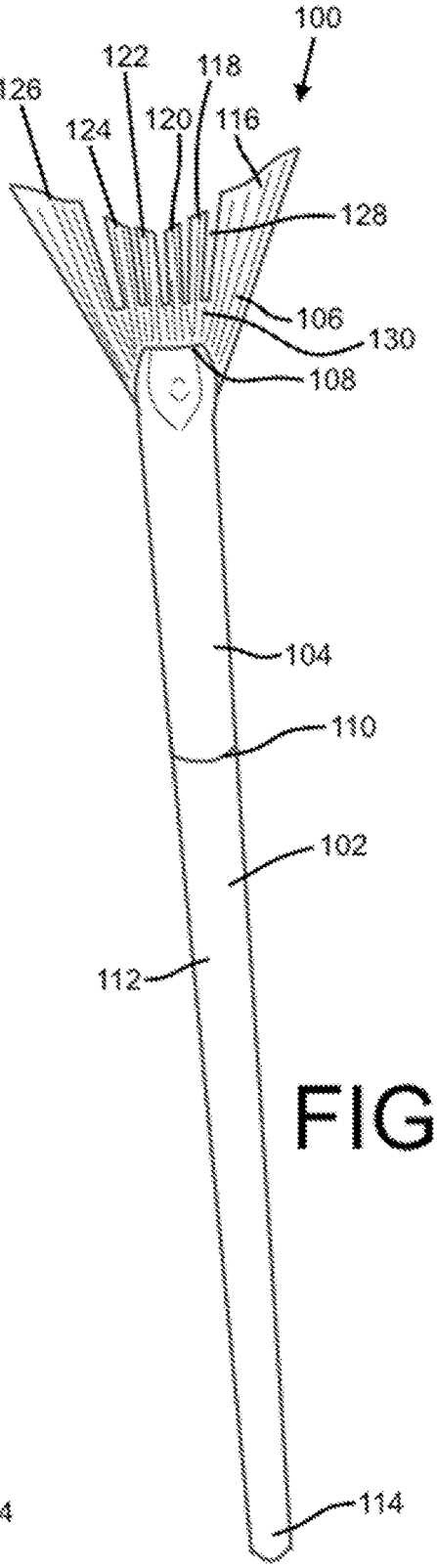
FIG. 1 shows a front view of a makeup brush in accordance with the present disclosure.

Various aspects are described below with reference to the drawings, and several of the elements are identified by numerals. The relationship and functioning of the various elements may better be understood by reference to the following description. However, aspects are not limited to those illustrated in the drawings or explicitly described below. The drawings are not necessarily to scale, and in certain instances, details may have been omitted that are not necessary for an understanding of aspects disclosed herein.

In this application, the use of the disjunctive is intended to include the conjunctive. The use of definite or indefinite articles is not intended to indicate cardinality. In particular, a reference to "the" object or "a or an" object is intended to denote also one of a possible plurality of such objects.

Figure 2:
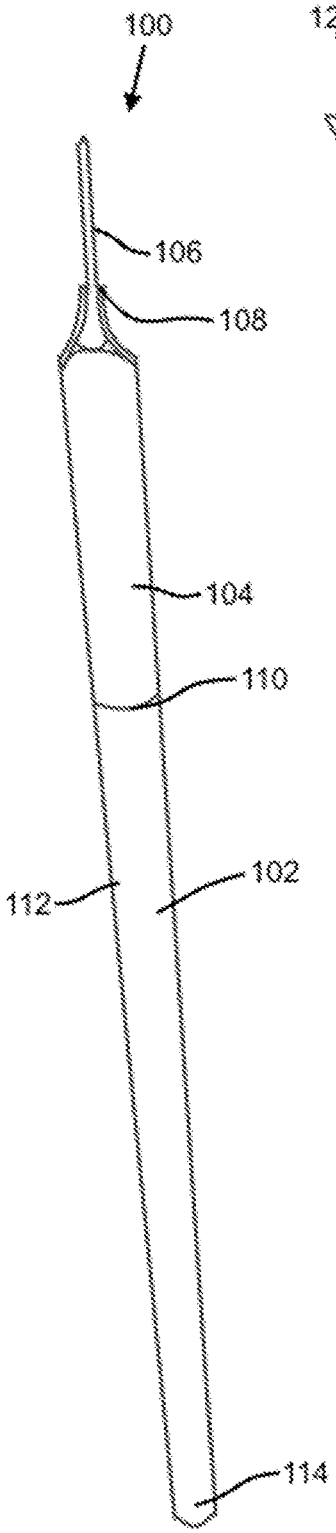
FIG. 2 shows a side view of the makeup brush of FIG. 1.

A front view of a makeup brush 100 is shown in FIG. 1, and a side view of the brush 100 is shown in FIG. 2. Referring to FIGS. 1-2, the makeup brush 100 may include a handle 102, a ferrule 104, and a brush portion 106. The brush portion 106 may extend from a forward end 108 of the ferrule 104, and the handle 102 may be disposed within a rearward end 110 of the ferrule 104. In some embodiments, the handle 102 may include a relatively thin front end portion (not shown) which may be partially engaged with or received in the rearward end 110 of the ferrule 104. The cross-section of the handle 102 may be sized to facilitate a holding of the makeup brush 100 with a user's fingers and may be approximately 0.5 cm in diameter in a non-limiting exemplary embodiment. Optionally, the handle 102 may be tapered such that a central portion 112 has a larger cross-section than the rear end portion 114. Without limitation, the handle 102 and/or the ferrule 104 may be circular, ovular, or rectangular in cross-section.

Optionally, the brush portion 106 may include a tufted look or construction defined by a plurality of bristle tufts (called "tuft groups"). When the brush portion 106 has distinct tuft groups, any suitable number of tuft groups may be included, such as the 6 tuft groups depicted in FIG. 1. Each of the tuft groups may be noticeably distinguishable from one another because of their correspondingly substantially dissimilar working lengths (i.e. respective lengths from the ferrule 104 to their terminal ends). As shown in FIG. 1, a first tuft group 116 may have relatively long bristles, a second tuft group 118 may have shorter bristles, and a third tuft group 120 may include even shorter bristles. Remaining tuft groups 122, 124, and 126 may have lengths similar to the third tuft group 120, the second tuft group 118, and the first tuft group 116, respectively. The brush portion 106 may be substantially symmetrical (as shown), but this is not required. The tuft groups 116 and 126 may be considered an outer pair, the tuft groups 118 and 124 may be considered an intermediate pair, and the tuft groups 120 and 122 may be considered an inner pair.

The tuft groups may form a particular profile, defined by the shape of working end of the brush portion 106, that matches a typical eyelash profile as defined by the shape formed by the ends of human eyelashes. As shown in FIG. 1, since the shortest tuft groups are near the middle of the profile of the brush portion 104 and the tuft groups increase in length moving radially outward, the profile is concave from the perspective of the forward end 108 of the ferrule 104, which may be suitable for receiving the convex profile of human eyelashes. Advantageously, the brush portion 106 can therefore apply mascara or another cosmetic product to a significant portion of (e.g., approximately the entire) profile of a set of eyelashes with one stroke, or through multiple strokes but without requiring a user to substantially reorient the brush 100 during the application procedure.

One of more of the tuft groups may be tapered toward its working end. As shown, the first tuft group 116 (and sixth tuft group 126) may be tapered at its working end such that an outer portion of the first tuft group 116 extends further from the ferrule 104 than an inner portion. Similarly, the second tuft group 118 and/or the third tuft group 120 (and the fourth/fifth tuft groups 122, 124) may be tapered such that outer portions of their working ends extends longer than inner portions. This construction may be advantageous for providing a profile of the brush portion 106 that more precisely aligns with a typical eyelash profile of a human. Further, tapers may provide a finer working ends for more precise user control.

As shown, a gap 128 may be formed between each of the tuft groups of the brush portion 106. The gaps may be formed by relatively short bristles (such as the bristles 130) placed between adjacent tuft groups. Alternatively, the tuft groups may be separated by spacers or due to the orientation of their installation in the ferrule 104. A brush portion 106 with separated tuft groups may be advantageous where it is desirable to provide mascara in a way such that eyelashes are separated into groups (e.g., where each group corresponds to a tuft) with minimal effort, which may give the eyelashes a fuller appearance. Separated tuft groups may also be advantageous for allowing the brush 100 to coat individual lash groups to help blend natural lashes with artificial lashes, for example. The size of the gaps may vary to determine the relative distance between adjacent tuft groups.

A shape or geometry of the forward end 108 of the ferrule 104 may determine the direction of extension of the bristles. For example, in FIG. 2, portions of the forward end 108 of the ferrule 104 may be angled relative to a longitudinal axis extending through the handle 102 and the ferrule 104. As a consequence, at least a portion of the bristles may extend outwardly at an angle to obtain a desirable working end width of brush portion 106. Some bristles (for example, those extending from near a center of the forward end 108) may be substantially parallel to the above-mentioned longitudinal axis. Additionally or alternatively, the bristles of the brush portion 106 may be compressed together near the forward end 108 of the ferrule 104 and then may fan outward as they extend towards the terminus of the brush 100.

The brush portion 106 may have particular dimensions specifically for application of cosmetic material to eyelashes. For example, a width of the brush portion, measured from the outer extremes of the outer-most tuft groups (in this case, tuft groups 116 and 126), may be between about 1 cm and about 3 cm, such as about 2 cm. In an exemplary embodiment, the longest tuft groups (e.g., tuft groups 116 and 126) may have a length of about 1.5 cm measured from the forward end 108 of the ferrule. The second tuft group 118 and fifth tuft group 124 may have a length of about 1 cm, and the third and fourth tuft groups 120 and 122 may have a length of about 0.7 cm. The thickness of the brush portion, measured in a plane perpendicular to a plane passing through each of the tuft groups (e.g., measured across the brush portion 106 from the perspective of FIG. 2), may range from about 0.5 mm to about 5 mm, and may be about 1.5 mm. Other suitable dimensions may be used. Each of the tuft groups may be configured (e.g., shaped and sized) for the picking up and holding of a desirable amount of makeup. In addition, a respective number of bristles allocated to each of the groups may vary, thereby determining a thickness of the mascara application at specific locations.

To secure the handle 102 to the ferrule 104, the rearward end 110 of the ferrule 104 may be crimped or glued to the front portion of the handle 102. In exemplary embodiments, the rearward end 110 of the ferrule 104 may be of substantially cylindrical form with a slightly larger diameter than that of the thinner front portion (not shown) of the handle 102 to fittingly engage the front portion of the handle 102. The ferrule 104 may be formed of a thin sheet of metal rolled into the cylindrical form, or may already be a thin metallic cylinder, for example. Preferably, a composition of the ferrule 104 is stainless steel for desirable strength and durability and in order to minimize any possibility of allergic reactions by the user. The ferrule 104 may be flattened into a substantially ovular or rectangular cross-sectional shape (or another shape) in proximity of forward end 108 to a thickness appropriate to securely hold desired brush portion 106. Further, all the bristles may be secured and anchored as a bundle or a plurality of bundles via their root ends (not shown) in the ferrule 104. These root ends may additionally or alternatively be bonded together by a suitable adhesive, such as epoxy or other suitable adhesive, to form at least one bristle knot upon hardening of the adhesive. Once cured or hardened in the ferrule 104, the adhesive may not only be adhered to the bristles but also to an interior surface of ferrule 104 to provide desirable securement. The bristles may be of any suitable synthetic, natural, or combination of materials.

Specific embodiments of a makeup brush have been described for the purpose of illustrating the manner in which the aspects of the present disclosure are used. It should be understood that the implementation of other variations and modifications of the embodiments described herein and their various aspects will be apparent to one skilled in the art, and that the invention is not limited by the specific embodiments described.

We claim:

1. A makeup brush, the makeup brush comprising:

a brush portion secured to a forward end of a ferrule, wherein the brush portion includes a plurality of tuft groups comprising inner tuft groups located between two outermost tuft groups, each tuft group formed by a plurality of bristles, wherein the tuft groups form a concave profile at a working end of the makeup brush, the concave profile configured to match a profile of human eyelashes, and wherein the outermost tuft groups of the plurality of tuft groups each taper outward as they extend from the ferrule, and wherein a terminus of each of the outermost tuft groups is wider that a terminus of each of the inner tuft groups.

2. The makeup brush of claim 1, wherein the plurality of tuft groups includes at least a first pair of tuft groups and a second pair of tuft groups, wherein a length of the first pair of tuft groups measured from the forward end of the ferrule to a terminus of the first pair of tuft groups is greater than a length of the second pair of tuft groups measured from the forward end of the ferrule to a terminus of the second pair of tuft groups.

3. The makeup brush of claim 2, further comprising a third pair of tuft groups, where each tuft group of the third pair of tuft groups is located between a tuft group of the first and second pairs of tuft groups.

4. The makeup brush of claim 2, wherein the first pair of tuft groups is an outer pair and the second pair of tuft groups is an inner pair.

5. The makeup brush of claim 1, wherein a gap is located between each of the plurality of tuft groups.

6. The makeup brush of claim 1, wherein a width of the brush portion measured from outer extremes of the outermost tuft groups is between about 1 cm and about 3 cm.

7. The makeup brush of claim 1, wherein at least one of the tuft groups of the plurality of tuft groups is tapered at its working end such that an outer portion extends further from the ferrule than an inner portion.

8. The makeup brush of claim 1, wherein the plurality of tuft groups includes at least a first pair of tuft groups and a second pair of tuft groups, wherein the first pair of tuft groups includes the outermost tuft groups, and wherein the each tuft group of the second pair of tuft groups is parallel to a longitudinal direction of a handle of the makeup brush.

9. A makeup brush, the makeup brush comprising:

a brush portion secured to a forward end of a ferrule, wherein the brush portion includes at least two pairs of tuft groups, a first pair being an outer pair and a second pair being an inner pair, and wherein a length of the first pair of tuft groups measured from the forward end of the ferrule to a terminus of the first pair of tuft groups is greater than a length of the second pair of tuft groups measured from the forward end of the ferrule to a terminus of the second pair of tuft groups, wherein each tuft group of the first pair of tuft groups tapers outward as it extends from the ferrule, and wherein the terminus of the first pair of tuft groups is wider than the terminus of the second pair of tuft groups.

10. The makeup brush of claim 9, wherein the at least two pairs of tuft groups form a concave profile at a working end of the brush portion, the concave profile configured to match the profile of human eyelashes.

11. The makeup brush of claim 9, further comprising a third pair of tuft groups, where each tuft group of the third pair of tuft groups is located between a respective tuft group of the first and second pairs of tuft groups.

12. The makeup brush of claim 11, wherein a length of the third pair of tuft groups measured from the forward end of the ferrule to a terminus of the third pair of tuft groups is greater than the length of the second pair of tuft groups.

13. The makeup brush of claim 9, wherein a gap is located between each adjacent tuft group of the at least two pairs of tuft groups.

14. The makeup brush of claim 9, wherein a width of the brush portion measured from outer extremes of the tuft groups of the first pair of tuft groups is between about 1 cm and about 3 cm.

15. The makeup brush of claim 9, wherein at least one tuft group of the at least two pairs of tuft groups is tapered at its working end such that an outer portion extends further from the ferrule than an inner portion.

16. The makeup brush of claim 9, wherein the each tuft group of the second pair of tuft groups is parallel to a longitudinal direction of a handle of the makeup brush.

17. A method for forming a makeup brush, the method comprising:

forming a brush portion secured to a forward end of a ferrule, wherein the brush portion includes a plurality of tuft groups comprising inner tuft groups located between two outermost tuft groups, each tuft group formed by a plurality of bristles, wherein the tuft groups form a concave profile on a working end of the makeup brush, the concave profile configured to match the profile of human eyelashes, and wherein the outermost tuft groups of the plurality of tuft groups each fan outward as they extend from the ferrule, and wherein a terminus of each of the outermost tuft groups is wider that a terminus of each of the inner tuft groups.

18. The method of claim 17, wherein the plurality of tuft groups includes at least a first pair of tuft groups and a second pair of tuft groups, wherein a length of the first pair of tuft groups measured from the forward end of the ferrule to a terminus of the first pair of tuft groups is greater than a length of the second pair of tuft groups measured from the forward end of the ferrule to a terminus of the second pair of tuft groups.

19. The method of claim 18, further comprising a third pair of tuft groups, where each tuft group of the third pair of tuft groups is located between a tuft group of the first and second pairs of tuft groups.

20. The method of claim 18, wherein the first pair of tuft groups is an outer pair and the second pair of tuft groups is an inner pair wherein the plurality of tuft groups includes at least a first pair of tuft groups and a second pair of tuft groups, wherein the first pair of tuft groups includes the outermost tuft groups, and wherein the each tuft group of the second pair of tuft groups is parallel to a longitudinal direction of a handle of the makeup brush.

* * * * *